US005617731A

United States Patent [19]

Scaringe

[11] Patent Number: 5,617,731

[45] Date of Patent: Apr. 8, 1997

[54] REFRIGERANT RECOVERY/RECYCLING SYSTEM

[75] Inventor: Robert P. Scaringe, Rockledge, Fla.

[73] Assignee: Mainstream Engineering Corporation, Rockledge, Fla.

[21] Appl. No.: 425,688

[22] Filed: Apr. 19, 1995

[51] Int. Cl.[6] ..... F25B 45/00

[52] U.S. Cl. ..... 62/149; 62/292; 62/475; 62/228.3

[58] Field of Search ..... 62/77, 85, 149, 62/125, 126, 292, 475, 228.3, 228.1

[56] References Cited

U.S. PATENT DOCUMENTS

| | | | |
|---|---|---|---|
| 3,699,781 | 10/1972 | Taylor . | |
| 4,285,206 | 8/1981 | Koser . | |
| 4,364,236 | 12/1982 | Lower et al. . | |
| 4,766,733 | 8/1988 | Scuderi | 62/292 |
| 4,768,347 | 9/1988 | Manz et al. . | |
| 4,805,416 | 2/1989 | Manz et al. . | |
| 4,809,520 | 3/1989 | Manz et al. . | |
| 5,193,351 | 3/1993 | Laukhuf et al. | 62/475 |
| 5,245,840 | 9/1993 | Van Steenburgh, Jr. . | |
| 5,277,033 | 1/1994 | Sanford et al. | 62/292 |
| 5,291,743 | 3/1994 | Van Steenburgh, Jr. et al. | 62/292 |

*Primary Examiner*—John M. Sollecito
*Attorney, Agent, or Firm*—Evenson, McKeown, Edwards & Lenahan, P.L.L.C.

[57] ABSTRACT

In a refrigerant recovery/recycling apparatus, a primary vapor-type filter/dryer is arranged downstream of the system inlet which receives recovered vapor refrigerant. The filter/dryer is provided with isolation valves upstream and downstream thereof so as to allow replacement of the cores. An oil separator is located downstream of the primary filter/dryer. To prevent excessive inlet pressures to the compressor of the recovery apparatus, a crankcase pressure regulator is provided upstream of the compressor inlet, in addition to high-and low-pressure shut-off switches. Furthermore, an oil separator is provided at the compressor outlet to remove any compressor oil from the superheated vapor refrigerant emerging from the compressor and returning that oil to the compressor via a return line. Condensed liquid refrigerant is provided to the recycling apparatus of the system by first passing through a second or recirculation filter/dryer, again one of conventional construction with replaceable filter cores. The filtered liquid refrigerant, from which non-condensable gas has been effectively removed by agitation in the filter/dryer, can then be supplied to an internal or external tank, and recycled through a hand expansion valve which throttles the liquid refrigerant into a vapor phase over a continuous range.

14 Claims, 2 Drawing Sheets

REFRIGERANT RECOVERY/RECYCLING SYSTEM

CROSS REFERENCE TO RELATED APPLICATION

This application is related to an application entitled PORTABLE REFRIGERANT RECOVERY SYSTEM filed in the name of Robert P. Scaringe, Fulin Gui and Steven D. Gann on Mar. 17, 1995, under Serial No. 08/405,681. The subject matter of that application, including the background discussion, is incorporated herein by reference.

BACKGROUND AND SUMMARY OF THE INVENTION

The present invention relates to an improved refrigerant recovery/recycling system and, more particularly, to a system in which a vapor-type filter/dryer is located before an oil separator to begin refrigerant cleaning by filtering out hard particles and removing acid and varnish from the incoming refrigerant, and to flash any trace amounts of liquid refrigerant into vapor. Moreover, a recirculation filter/dryer provides both filtration and agitation to remove non-condensable gas from the condensed liquid refrigerant.

Refrigerant recovery system and recovery/purification system are generally known as seen, for example, in U.S. Pat. Nos. 3,699,781; 4,285,206; 4,364,236; 4,805,416; 4,768,347; 4,809,520; 5,072,593; and 5,245,840.

One major problem with these systems is that they do not remove the major portion of dirt, moisture and acid from the system as early as possible to prevent damage to the system, particularly in the recirculation portion where it is necessary, when desired, to purify the refrigerant. Moreover, in at least some conventional systems, the entire system must be emptied when a filter becomes clogged and must be replaced.

Conventional systems use high-and low-pressure shut offs for the compressor, but these systems do not adequately protect against excessively high and harmful pressures resulting from the initial quantity of refrigerant from the system being emptied and/or the setting of a recirculation valve. Furthermore, the conventional systems do not provide low-and high-pressure shut-offs which, in the case of the former, prevents system start-up unless the pressure is above a predetermined amount, e.g. 5 psig, in order to avoid start up in a system filled with air and optionally provides an override to obtain lower system pressures.

Also, conventional recovery/recycling systems have not recognized the advantage of providing a crankcase pressure regulating device, a low pressure override or ambient pressure interlock.

Heretofore, recycling apparatus did not provide an effective way of eliminating non-condensable gases from liquid refrigerant after being received from a condenser of the recovery apparatus so as to prevent the recycling of a substantially pure refrigerant.

Accordingly, it is one object of the present invention to provide a system which eliminates hard particles and other contaminants in the vapor refrigerant before passage thereof through the remainder of the systems.

It is a further object of the present invention to prevent excessive inlet pressure to a recovery apparatus compressor and thereby avoid excessive compressor discharge pressure.

A further object of the present invention is to substantially desorb all non-condensable gases in the liquid refrigerant received in the recycling section of the system in a very simple manner.

A still further object of the present invention is to achieve a continuous range of recycling conditions so as, on one hand, to quickly clean the refrigerant and, on the other hand, to assist in removal of the non-condensable gases from the liquid refrigerant.

The foregoing and other objects have been achieved in accordance with the present invention by providing a primary vapor-type filter/dryer with replaceable cores immediately downstream of the system inlet which receives recovered vapor refrigerant from, for example, a refrigeration system of a generally known type. The filter/dryer can be provided with isolation valves upstream and downstream thereof so as to allow replacement of the cores without emptying the entire system of recovered refrigerant.

According to another feature of the present invention, an oil separator is located downstream of the primary filter/dryer. In one embodiment, the oil separator can optionally be surrounded by a tube-within-tube heat exchanger for flashing any trace amounts of liquid refrigerant in the recovered vapor refrigerant. However, advantageously, such a heat exchanger is not necessary to achieve the objectives of the present invention in which vapor refrigerant is being recovered.

To prevent excessive inlet pressures to the compressor of the recovery apparatus, a crankcase pressure regulator is provided upstream of the compressor inlet, in addition to high-and low-pressure shut-off switches. Furthermore, an oil separator of, for example, the centrifugal type is provided at the compressor outlet to remove any compressor oil from the superheated vapor refrigerant emerging from the compressor and returning that oil to the compressor via a return line.

Condensed liquid refrigerant is provided to the recycling apparatus of the system by first passing through a second or recirculation filter/dryer, again one of conventional construction with replaceable filter cores. The filtered liquid refrigerant, from which non-condensable gas has been effectively removed by agitation in the filter/dryer, can then be supplied to an internal or external tank, and recycled through a hand expansion valve which throttles the liquid refrigerant into a vapor phase over a continuous range. According to one embodiment, the throttled refrigerant can be passed through a coiled heat exchanger tube surrounding the recirculation filter/dryer and/or an internal tank to aid in the removal of non-condensable gas from the liquid refrigerant. Alternatively, the throttled recycled refrigerant can advantageously be passed through a separate heat exchanger in thermal communication with the superheated vapor from the compressor to assure that the recycled refrigerant being supplied to the compressor through a one-way check valve is substantially all vapor.

BRIEF DESCRIPTION OF THE DRAWINGS

These and other objects, features and advantages of the present invention will become more readily apparent from the following detailed description thereof when taken in conjunction with the accompanying drawings wherein.

DETAILED DESCRIPTION OF THE DRAWINGS

Figure 1:
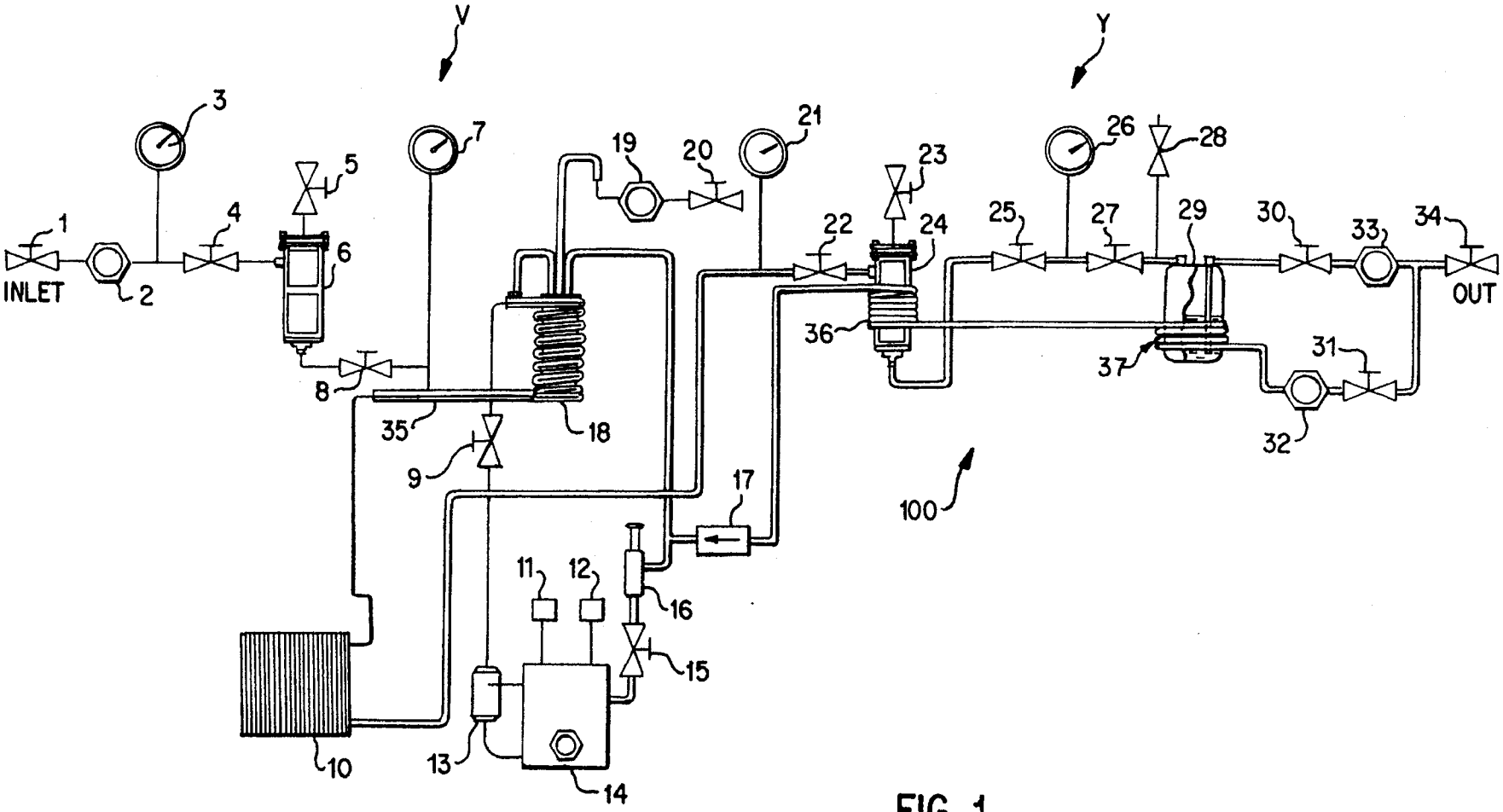
FIG. 1 is a schematic view of an embodiment of my improved refrigerant recovery/recycling system in which recycled refrigerant is passed through heat exchangers surrounding a recirculation filter/dryer and internal tank.

Referring now to FIG. 1, the recovery/recycling machine of the present invention is designated generally by the numeral 100 and consists essentially of a recovery section V and a recycling section Y. Vapor refrigerant being recovered from, for example, a refrigerant system, enters the system 100 via the inlet valve 1 and flows past an inlet sight glass 2 to allow the system operator to visualize the state of the incoming refrigerant and then through an inlet (low-side/low pressure) pressure gauge 3. The sight glass 2 can be provided with a moisture indicating element in a known manner to provide an indication of moisture level.

After passing from the gauge 3 through an isolation valve 4, the incoming vapor refrigerant then enters a vapor-only two core primary filter/dryer 6 such as, for example, a commercially available Parker Model P967 or Sporland filter/dryer having replaceable core shells. The placement of the primary filter/dryer 6 near the system inlet and upstream of a waste oil separator 18 has two main advantages. Namely, the filter/dryer 6 filters and removes the major dirt, moisture, and acid from the system 100 as early as possible before these contaminates can reach the recirculation portion Y of the system 100, and it serves as a source of significant liquid pressure drop, to aid in the flash vaporization of any trace amount of liquid refrigerant that may be entrained in the recovered vapor. Vapor filter cores are used to increase the liquid pressure drop and further aid in this liquid flashing. Due to the significantly lower viscosity of vapor, the vapor flow rate is not significantly reduced or negatively impacted by the filter/dryer 6 and is a particular advantage of recovering vapor rather than liquid refrigerant which requires vaporization.

Optionally, the filter/dryer 6 can also be heated to increase trace liquid flashing, but this is unnecessary to achieve the objectives outlined above. The vapor areas in the primary filter/dryer 6 are high-capacity vapor filter cores even though small amounts of liquid refrigerant may enter the unit. Either standard motor burn-out (high acid removal) or high-moisture removal vapor filter/dryer cores for the filter/dryer 6 can be used within the scope of the present invention.

Pressure gauges 3, 7 are located on the upstream and downstream sides of the primary filter/dryer 6 to provide a continuous indication of the pressure drop across the primary filter/dryer 6. Because clogged filters result in significantly increased pressure drop, the system 100 uses isolation valves 4, 8, valves on each side of the filter/dryer to isolate the filter/dryer 6 from the system so that the filter/dryer cores can be changed without the need to empty recovered refrigerant from the entire system.

Refrigerant from the primary filter/dryer 6 then passes the second pressure gauge 7 and, optionally, enters a conventional tube-within-a-tube counterflow heat exchanger 35 such as the commercially available Parker Dual Heat Transfer Coils (Part No. DHTC-CU-4) to vaporize any trace amounts of inlet liquid refrigerant which has not been already flashed into vapor in the primary filter/dryer 6. I have found such a heat exchanger to be unnecessary to practice my invention. The heat to perform this optional vaporization step is obtained by passing hot gas exhausting from a discharge of a compressor 14, as hereinafter described, into the center of the tube-within-a-tube heat exchanger 35. To further increase heat transfer, the spiral heat-exchange tube is wrapped around the aforementioned conventional waste oil separator 18, such as a commercial AC&R Components, Inc. separator, so that the hot compressor gas discharge heats the waste oil separator 18 and the inlet refrigerant after passing through the primary filter/dryer 6.

The vapor refrigerant from the primary filter/dryer 6 or, alternatively, the heated incoming vapor refrigerant leaving the tube-within-a-tube heat exchanger 35 then enters the waste oil separator 18 to separate out the waste or recovered oil from the substantially vapor refrigerant. The oil separator 18 is also a liquid separator so that any incoming liquid refrigerant is trapped therein as is the incoming waste oil, by the action of the separator. Any trapped trace liquid refrigerant will be in a transient non-equilibrium condition and therefore boils off from the trapped oil. This boiling of any trapped refrigerant would, of course, be marginally accelerated by heating the oil separator 18 in the optional embodiment described above. When the waste oil level in the waste oil separator 18 reaches a predetermined point, a float-controlled valve inside the oil separator 18 opens in a known manner to allow waste oil to drain through a sight glass 19 to an oil drain valve 20 and an optional secondary storage tank (not shown).

Depending on the initial refrigerant quantity in the system to be emptied, or the setting of the hereinafter described recirculation valve 22, the inlet pressure to the compressor 14 can be quite high and thus result in an excessive compressor discharge pressure which could cause premature system, high-pressure shut-down, compressor damage, and compressor motor overloading. Therefore, refrigerant vapor which leaves the waste oil separator 18 is then selectively combined with recirculated refrigerant passing through a one-way check valve 17 (hereinafter described), and the combined flow enters a commercially available crankcase-pressure regulator 16, e.g a Sporland Crankcase Pressure Model CROT-6 regulator or Model CROT-10 regulator before entering the compressor 14. The crankcase-pressure regulator 16 is a conventional spring-actuated valve which reduces excessive inlet pressure to the compressor 14, thereby automatically regulating this inlet pressure and avoiding the aforementioned problems.

The compressor 14, also of known construction, is provided with a high pressure shut-off 11 to turn the system off automatically if the pressures should become too high, i.e. if the crankcase-pressure regulator 16 should fail or due to some other reason such as a clogged line or the like, and also an adjustable low pressure shut-off switch 12 to turn the system off automatically below the desired low (recovery) pressure. The low pressure switch 12 is configured with a turn-on pressure that will not allow the system 100 to start-up unless the system pressure is above a predetermined amount, e.g. about 5 psig for R-12 or R-22, and also keeps the system operator from using a system that might have been opened to the atmosphere, and thereby filled with air (ambient pressure interlock).

Another optional feature is a low-pressure override which allows the low-pressure shut-off switch 12 to be overridden to obtain lower system pressures when desired. Further, the compressor 14 can be provided with an oil sight-glass to visually check the compressor oil level. Isolation valves 9, 15 (which valves are located as close to the compressor 14 as possible depending on the selected oil separator configuration) are arranged to permit selective isolation of the compressor 14 from the system 100, thereby allowing oil changes in the compressor 14 without emptying the entire system of refrigerant.

Superheated vapor refrigerant emerging from the compressor 14 passes through an oil separator 13 to separate out compressor oil and return that oil back to the compressor 14. When convenient, the discharge line is oriented vertically or is at least sloped to allow oil to drain from the separator's refrigerant discharge line back into the oil separator 13 and from the oil separator 13 to the compressor 14. The oil separator 13 can be a commercially available waste oil/centrifugal separator. The discharged refrigerant, after having the compressor oil separated and returned to the compressor 14, is used to heat the incoming refrigerant and the first-mentioned waste-oil separator 18 as described above.

The refrigerant vapor then passes through a conventional air cooled (forced convection) condenser 10 with flow downward to the point where condensed refrigerant exits. The condensed refrigerant exiting the bottom of the condenser 10 enters the recycling portion Y of the system through a secondary or recirculation filter/dryer 24, also of known construction, after passing through the open recirculation valve 22. In addition to its function of filtering and drying of the condensed refrigerant, the recirculation filter/dryer 24 effectively agitates the condensed refrigerant, thereby significantly and advantageously increasing the separation (or desorbtion) of non-condensable gas from the condensed liquid refrigerant. To lower the solubility of the non-condensable gas in the liquid refrigerant, the recirculation filter/dryer 24 can optionally be cooled by a heat exchanger 36 with the hereinafter described recirculation flow stream. The combination of cooling and agitation provided by the filter/dryer 24 significantly improves the effectiveness of non-condensable gas removal from the system.

Non-condensable gas which comes out of the liquid refrigerant is vented in any of the normally liquid portions of the system loop such as from the top of the condenser 10, the top of a hereinafter discussed liquid receiver 29, or from the top of the recirculation filter/dryer 24. The non-condensable gas is vented from the recirculation filter/dryer 24, for example, automatically via a solenoid valve 23 when the pressure is above the saturation pressure for the refrigerant temperature. Alternatively, the non-condensable gas can be removed via a simple timed or manual gas purge at predetermined times or predetermined recovery quantities in a manner known in this refrigerant recovery/recycling art.

The location of the recirculation filter/dryer 24 is an optimum non-condensable gas removal point because the natural agitation provided by the filter/dryer core combined with the cooling of liquid refrigerant there results in highly effective non-condensable gas separation. Subsequent cooling of the liquid receiver 29 is of marginal benefit for additional non-condensable gas removal, but it does provide additional heat transfer surface area for liquid refrigerant cooling.

The secondary or recirculation filter/dryer 24 of known construction uses two standard liquid or vapor type filter/dryer cores to effectively remove varnishes, sludge, moisture, and acid from the refrigerant. Pressure gauges 21, 26 are located on both sides of the recirculation filter/dryer 24 to provide a continuous indication of the pressure drop across the filter/dryer 24 for the reason mentioned above in connection with filter/dryer 6. Isolation valves 22, 25 on each side of the filter/dryer 24 provide isolation thereof from other parts of the system 100 so that the entire system does not need to be emptied in order to change the filter/dryer cores as is also the case with the primary filter/dryer 6.

Refrigerant which leaves the recirculation filter/dryer 24 then flows past a pressure gauge 26 to a liquid storage vessel 29 which can be a conventional liquid receiver such as, for example, a commercially available Refrigeration Research Model 1911 or an external DOT-approved refrigerant recovery tank (e.g. Amtrol, Manchester, Worthington are several manufacturers who make tanks in sizes such as 30 lb, 50 lb, 100 lb, 250 lb, or 1,000 lb). In these conventional liquid receivers or liquid storage tanks, the liquid refrigerant enters the unit at the side or top and then gravity flows to the bottom of the unit. Liquid is removed from the tank bottom, either via a connection at the bottom or via a connection at the top with a dip-tube that extends to the bottom of the tank. The liquid which is removed from the liquid receiver 29 flows past an isolation valve 30, an outlet sight glass 33 and the outlet valve 34. Optionally, the liquid storage vessel 29 can be cooled with a cooled tube heat exchanger 37 through which throttled vapor refrigerant passes as described herein below, but cooling is normally not required.

Storage tanks used in the system 100, whether internal or external, are equipped in a known manner with a floatswitch to assure that the storage tanks are not filled with more than 80% of liquid by volume because of the necessity to have an expansion space for the liquid refrigerant as it heats during the day. The liquid section of the system 100 between the inlet valve 22 and the outlet 34 must also be equipped with a conventional pressure-relief valve 28 to avoid overpressurization of the system 100 due to tank float failure, line clogging, and the like. The pressure relief valve 28 can be located anywhere in the liquid stream, e.g. on DOT approved refillable recovery storage tanks. When an external tank 29 is used, isolation valves 27, 30 are used to allow tanks to be switched again without emptying the entire system.

Liquid refrigerant is also selectively cycled or diverted from the outlet liquid stream from the unit 29 for recirculation back through the filtration system to improve refrigerant purity. The recirculation connection point can be located anywhere downstream of the recirculation filter/dryer 24. However, by diverting the flow after the liquid storage tank 29, which acts as a liquid accumulator, a diversion of a liquid stream is obtained. The recirculation flow rate is controlled by using a standard refrigeration hand-expansion valve 31 to throttle the recirculated refrigerant and thereby drop its pressure to obtain a vapor refrigerant. The throttled vapor refrigerant passes through a check valve 17, which prevents backflow of incoming recovery refrigerant into the liquid storage tank, and joins the inlet vapor stream in the recovery portion V prior to entering the crankcase pressure regulator 16 and the compressor 14 to repeat recirculation (or secondary filtration). A sight-glass 32 is arranged downstream of the recirculation throttling valve 31 to allow the operator to visually observe the refrigerant and the vapor fraction being recirculated.

The above-described crankcase pressure regulator 16 also prevents excessive compressor inlet pressure in the event that the operator opens the hand expansion valve 31 too much in an attempt to maximize the recirculation rate. Both components 16, 31 are therefore important to ensure proper operation of the system 100. A commercially available hand-expansion valve 31, rather than a typical refrigeration valve, is used because a full-open, hand-expansion valve provides a more significant flow restriction than the typical refrigeration valve, and a pressure drop is key to the throttling operation, whereas a full-open ordinary hand-valve will provide very little flow restriction. Also hand-expansion valves provide a finer level of flow control than ordinary hand-valves.

The hand expansion valve 31 can also optionally control the temperature of the recycled refrigerant which is cooled in the recirculation filter/dryer 24 and also optionally in the liquid receiver 29 because the throttled (recirculated) refrigerant can be used to cool the liquid refrigerant via the above-described heat exchanger 36 formed by piping wrapped around the exterior of the recirculation filter/dryer 24 and, optionally, by piping 37 wrapped around the liquid receiver 29. This is in certain cases a mutually beneficial approach since cooling the liquid refrigerant increases the ease of removing non-condensable gases from the refrigerant and makes refrigerant transfer easier. The heat removed from the stored liquid refrigerant serves to provide the required vaporization of the recirculated refrigerant because the compressor 14 cannot compress liquid. Moreover, the liquid refrigerant cooling does improve refrigerant transfer as well as non-condensable gas removal.

The position of the hand-expansion valve 31 to provide throttling and the resulting downstream pressure controls the refrigerant cooling temperature, since the pressure and temperature of this saturated mixture is controlled by the saturation/temperature pressure curve for the refrigerant. The downstream pressure and its corresponding temperature are both displayed on the low pressure refrigerant gauge 7 and can be set by the system operator. This simple throttling approach allows a continuous range of recycling options. For example, the operator can obtain rapid recycling by setting the valve 31 to low pressure drop and essentially no cooling by substantially opening the valve 31. This provides rapid cleaning of the refrigerant via multiple passes through the recirculation filter/dryer 24 because, with a lower pressure drop, the flow rate through the recirculation loop is increased. Furthermore, the crankcase-pressure regulator 16 protects the compressor 14 from liquid at the inlet.

Alternatively, the operator can significantly cool the refrigerant by closing the hand-expansion valve 31 more and more and thereby increase the pressure drop across the valve 31. The recirculation rate, recirculation pressure and temperature are lowered, and thereby, via the optional heat exchangers 36 and/or 37, the liquid refrigerant temperature is lowered because the liquid refrigerant is cooled in the recirculation filter/dryer 24 before entering the liquid storage tank 29 and also in the storage tank.

Rapid recirculation (i.e. open valve 31) is recommended to clean refrigerant first, followed by liquid cooling (via cooling of the recirculation filter/dryer 24) for non-condensable gas removal and better refrigerant transfer. Non-condensable gas which comes out of the liquid refrigerant is ventable in any of the aforementioned customary ways. The liquid refrigerant which must pass through the filter/dryer 24 is, however as above noted, agitated by the filtration process and, combined with the recirculation cooling, provides an excellent de-gassing method.

The refrigerant can be continuously recirculated either during or after refrigerant recovery. The recirculation rate, the high-side pressure and the low-side pressure are controlled by the setting of the recirculation valve 31 by which the opening of the valve 31 results in an increased recirculation flow rate but a decrease in the high-side to low-side pressure ratio. If refrigerant is being recovered at the same time as recirculation is occurring, the recovery will be slower because the recovery inlet pressure has increased. Hence, where possible, recovery should be performed first with the recirculation valve 31 fully closed, and then recirculation of the refrigerant should occur after all refrigerant has been recovered. The liquid refrigerant that is recirculated through the hand expansion valve 31 is vaporized and provides the cooling to cool the liquid contained in the recirculation path including the recirculation filter/dryer 24. Cooling of the liquid refrigerant reduces the capacity of the liquid to trap non-condensable gases, such as air in the above-described manner.

As in the above-referenced co-pending application, an electric control circuit is utilized which includes a low-voltage control safety circuit with a low-pressure shut-off, high-pressure shut-off, and tank-full shut-off. This low-voltage circuit operates at 24 VDC to increase contact switch life. A conventional 24 VAC transformer and two diodes are used to obtain the DC current. Each safety switch is normally closed and allows a low-voltage control loop to be normally closed to thereby actuate the coil of a double-pole relay. Each safety switch has a corresponding indicator light and 1000 ohm resistor mounted in parallel to the switch. As a result, when the normally-closed switch opens in the fault condition, the indicator light is illuminated, but the current flow is too low to activate the relay coil and energize the circuit. When the relay is closed, the 110 VAC (or other high voltage power, e.g. 220 VAC, 460 VAC) is directed to the compressor 14. A conventional start capacitor, run capacitor, start relay, and thermal overload circuit are activated when the relay is closed by energizing the relay coil. The tank-full safety switch is a normally-closed, magnetic-reed-type float switch located in the storage tank. The switch in the external tank is connected to the recycling unit with a three wire connection, with two of the wires for the switch circuit and a ground wire for safety. The control circuit operates on only 24 volts and the wiring connector on the unit has a shut-cap which by-passes this external tank float switch for occasions where an external tank is not used or an external tank without a fail-safe float switch is being used. With a fail-safe float-switch, the unit will stop if the float control circuit should open because of a damaged wire or loose connection.

I have found that the basic low-voltage control circuit can be sensitive to intermittent opening and closing of the safety switches due, for instance, to high pressure fluctuations or agitation of the tank liquid level when the tank is essentially full, resulting in the tank float switch opening and closing. To avoid short cycling of the compressor, which severely shortens the compressor life, a latching circuit has been added to the basic control circuit. With this latching circuit modification, the low voltage control circuit is not completed initially when all the safety switches are closed until a momentary manual start/override switch is depressed. Depressing this latter switch completes the low-voltage circuit, and causes the relay to close. Once the relay is closed, the second contact on the relay, which is wired in parallel to the manual start switch, is closed to complete the circuit, and the manual start switch need not be depressed any longer. This manual start switch is wired in parallel to both the relay contact and the low pressure switch so it also serves as a low pressure override, allowing the user to manually override the low pressure cutoff as long as the switch is depressed. This system has only one main power circuit breaker/switch and one momentary push-button switch to start the system and/or override the low-pressure shut-off.

Figure 2:
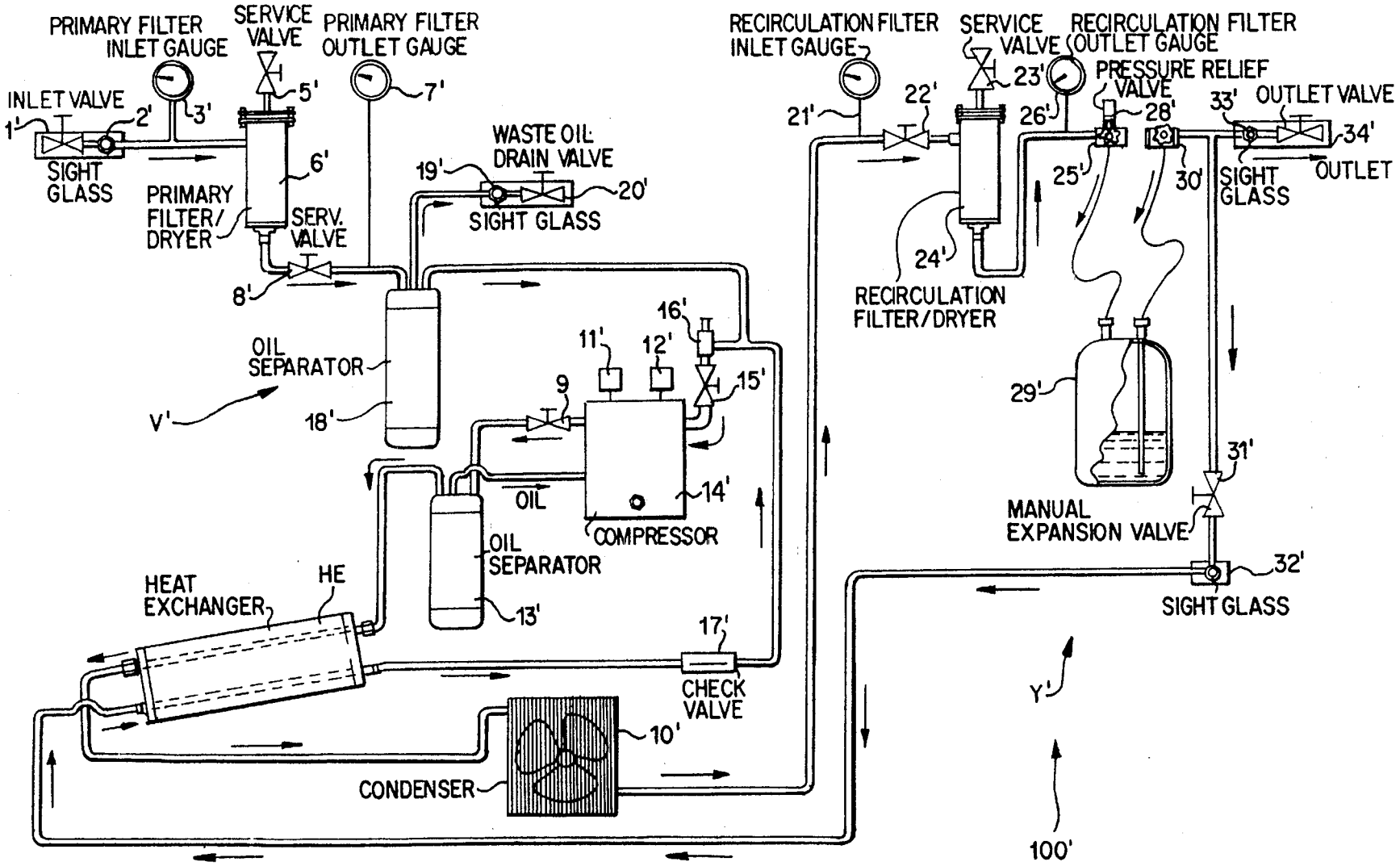
FIG. 2 is a schematic view of a second embodiment of my invention in which the recovery oil separator is not heated and the recycled refrigerant is passed through a separate heat exchanger in thermal communication with superheated compressed vapor refrigerant in the recovery section.

In another embodiment of the recovery/recycling machine according to the present invention designated generally by numeral 100' in FIG. 2, parts similar in construction and function to those described above in reference to FIG. 1 are designated by the same numerals but primed. The vapor refrigerant being recovered enters through an inlet valve 1' which also has a sight glass 2', past an inlet gauge 3' to a primary filter/dryer 6' which has a service valve 5'. In addition to inlet valve 1' which also serves as an isolation valve, an isolation valve 8' is provided downstream of the primary filter/dryer 6' which is also of the vapor-type having replaceable filter cores.

The vapor refrigerant then is led into the oil separator 18' and from there to the compressor 14' via the crankcase pressure regulator 16'. The superheated compressed vapor refrigerant is then passed through an oil separator 13' which returns compressor oil to the compressor 14' via a return line. The superheated vapor refrigerant from the compressor discharge is then passed through a heat exchanger HE which is slightly inclined and heats the recirculated vapor from the recycling portion Y'. The slight inclination of the heat exchanger HE helps to assure that condensing refrigerant at the compressor discharge drains toward the condenser, and that trace liquid in the recycling line is kept away from the compressor suction side.

The recycling portion Y' of the system 100' is essentially the same as that in FIG. 1 with the exception that the recycled vapor refrigerant from the expansion valve 31' does not pass through a coil heat exchanger around either the recirculation filter/dryer and/or the storage tank. Therefore, a further description of the operation of the recycling portion Y' is unnecessary.

Although the invention has been described and illustrated in detail, it is to be clearly understood that the same is by way of illustration and example, and is not to be taken by way of limitation. For example, the system can be air powered instead of electrically powered. The spirit and scope of the present invention are to be limited only by the terms of the appended claims.

I claim:

1. A refrigerant recovery/recycling system, comprising a primary filter/dryer operatively arranged near an inlet of the system for filtering vapor refrigerant being recovered;

an oil separator located downstream of the primary filter/dryer to receive recovered vapor refrigerant from the latter;

a compressor operatively arranged downstream of the oil separator;

a condenser operatively arranged downstream of the compressor; and a recycling apparatus operatively associated with the condenser, wherein a crankcase pressure regulator is operatively arranged at a section inlet side of the compressor, high-pressure and low-pressured shut-off valves are operatively associated with the compressor, and the low-pressure shut-off valve is provided with an override to allow the use of lower system pressures.

2. The system according to claim 1, wherein the recycling apparatus comprises a recirculation filter/dryer arranged to receive liquid refrigerant from the condenser, and an expansion valve for selectively recycling refrigerant to the compressor.

3. The system according to claim 1, wherein an isolation valve is operatively arranged at an upstream location and at a downstream location with respect to the primary filter/dryer.

4. The system according to claim 1, wherein a second oil separator is operatively arranged downstream of the compressor, and a return line communicates the second oil separator with the compressor.

5. The system according to claim 2, wherein an isolation valve is operatively arranged at an upstream location and at a downstream location with respect to the recirculation filter/dryer.

6. The system according to claim 2, wherein a line for recycling refrigerant from the expansion valve to the compressor is configured to have at least one coiled tube heat exchanger in thermal communication with at least one of the recirculation filter/dryer and a liquid storage tank.

7. The system according to claim 1, wherein means is associated with the recycling apparatus for venting non-condensable gas from liquid refrigerant therein.

8. A refrigerant recovery/recycling system, comprising a primary filter/dryer operatively arranged near an inlet of the system for filtering vapor refrigerant being recovered;

an oil separator located downstream of the primary filter/dryer to receive recovered vapor refrigerant from the latter;

a compressor operatively arranged downstream of the oil separator;

a condenser operatively arranged downstream of the compressor; and a recycling apparatus operatively associated with the condenser, wherein the recycling apparatus comprises a recirculation filter/dryer arranged to receive liquid refrigerant from the condenser, an expansion valve for selectively recycling refrigerant to the compressor, and a heat exchanger is provided for thermal communication between a line from the expansion valve to a suction inlet of the compressor and a line from a discharge outlet of the compressor to the condenser.

9. The system according to claim 8, wherein an isolation valve is operatively arranged at an upstream location and at a downstream location with respect to the primary filter/dryer.

10. The system according to claim 9, wherein a crankcase pressure regulator is operatively arranged at a suction inlet side of the compressor.

11. The system according to claim 10, wherein high-pressure and low-pressure shut-off valves are operatively associated with the compressor.

12. The system according to claim 11, wherein the low-pressure shut-off switch is provided with an override configured to assure a predetermined low system pressure.

13. The system according to claim 8, wherein a second oil separator is operatively arranged downstream of the compressor, and a return line communicates the second oil separator with the compressor.

14. The system according to claim 8, wherein an isolation valve is operatively arranged at an upstream location and a downstream location with respect to the recirculation filter/dryer.

* * * * *